US007070254B2

(12) United States Patent
Kamiyama

(10) Patent No.: US 7,070,254 B2
(45) Date of Patent: Jul. 4, 2006

(54) NOZZLE CLOGGING DETECTION DEVICE, DROPLET EJECTING DEVICE, ELECTRONIC OPTICAL DEVICE, METHOD FOR PRODUCING SAME, AND ELECTRONIC DEVICE

(75) Inventor: Nobuaki Kamiyama, Fujimi-machi (JP)

(73) Assignee: Seiko Epson Corporation (JP)

( * ) Notice: Subject to any disclaimer, the term of this patent is extended or adjusted under 35 U.S.C. 154(b) by 305 days.

(21) Appl. No.: 10/744,701

(22) Filed: Dec. 22, 2003

(65) Prior Publication Data

US 2004/0206179 A1 Oct. 21, 2004

(30) Foreign Application Priority Data

Dec. 25, 2002 (JP) ..... 2002-374774

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,689,288 A * 11/1997 Wimmer et al. ..... 347/7
6,044,694 A * 4/2000 Anderson et al. ..... 73/54.41
6,719,211 B1 * 4/2004 Takeuchi et al. ..... 239/102.2

FOREIGN PATENT DOCUMENTS

JP 2001-212970 8/2001

* cited by examiner

*Primary Examiner*—Thinh Nguyen
(74) *Attorney, Agent, or Firm*—Harness, Dickey & Pierce, P.L.C.

(57) ABSTRACT

A head 20, controlled by control unit 10, ejects a droplet 22 through each nozzle in nozzle group 2. Measuring means 33 electronically measures a resonance frequency of crystal oscillator 31 and outputs the measured resonance frequency to control unit 10. Control unit 10 determines whether or not a nozzle is clogged on the basis of the measurement result of a resonance frequency of the crystal oscillator before and after the ejection of droplet 22.

11 Claims, 5 Drawing Sheets

NOZZLE CLOGGING DETECTION DEVICE, DROPLET EJECTING DEVICE, ELECTRONIC OPTICAL DEVICE, METHOD FOR PRODUCING SAME, AND ELECTRONIC DEVICE

TECHNICAL FIELD

The present invention relates to a nozzle clogging detection device for detecting clogging of a nozzle by ejecting droplets; a droplet ejecting device comprising the nozzle clogging detection device; a method for producing an electronic optical device, using the droplet ejecting device; an electronic optical device produced by using the method; and an electronic device having the electronic optical device mounted thereto.

BACKGROUND ART

Droplet ejecting devices are used for various industrial purposes, an example of which is forming film of a polymeric material for use as luminescent layer material of organic EL.

A droplet ejecting device generally has a droplet ejecting mechanism called a "head", and has a configuration wherein a plurality of nozzles are arranged in a particular order at the head and a liquid is ejected through the nozzles in a form of droplets.

Generally, the diameter of a nozzle for ejecting a droplet is extremely small. Accordingly, nozzle clogging resulting from the viscosity of a liquid to be ejected is, to some extent, inevitable. A clogged nozzle left unchecked, can in an extreme case cause a so-called dead pixel phenomenon, where no droplet can be ejected via the nozzle. To avoid product deterioration directly caused by the dead pixel phenomenon, a conventional droplet ejecting device uses a laser beam for determining whether a nozzle is clogged, by detecting a change in luminous energy of the laser beam which is caused when a droplet falling from a nozzle intersects the laser beam.

In this conventional method, however, it is difficult to install a laser accurately enough that a path of a falling droplet intersects the laser beam. In addition, since it is necessary to eject a plurality of droplets per nozzle to make an accurate detection, and since nozzle clogging is detected while a head or a detection device is moving, the process becomes complex and, furthermore, in a case where a liquid to be ejected is very expensive, cost becomes a significant factor.

SUMMARY

The present invention has been conceived in consideration of the above mentioned difficulties, and an object of the invention is to provide: a nozzle clogging detection device which has fewer constraints in installation, which is accurate, and which requires a less complex process of operation; a droplet ejecting device having the nozzle clogging detection device; a method for producing an electronic optical device, using the droplet ejecting device; an electronic optical device produced by using the method; and an electronic device in which the electronic optical device is provided.

To solve the above-mentioned problems, the present invention provides: a nozzle clogging detection device for detecting clogging of a nozzle which ejects a droplet, comprising a piezoelectric element which is held between two electrodes, and resonates at a certain frequency by being applied a voltage thereto; a measuring means for measuring a resonance frequency of the piezoelectric element; and a determining means for determining that a nozzle clogging has occurred in nozzle, by obtaining a resonance frequency of the piezoelectric element measured by the measuring means before and after the point of time at which a droplet is to be ejected via the nozzle to the piezoelectric element, when the difference between the obtained resonance frequencies is below a predetermined value.

In the nozzle clogging detection device, the change in resonance frequency of an electrode can be detected as long as a droplet adheres to the electrode. Accordingly, constraints in installing the device can be reduced and further, the load accompanied by the installation can also be greatly reduced.

In addition, since the nozzle clogging detection device enables the detection of change in resonance frequency of an electrode when only one droplet adheres to the electrode, it is not necessary to eject a plurality of droplets from a nozzle, thereby greatly reducing the cost of the operation.

Further, the present invention provides a droplet ejecting device comprising the aforementioned nozzle clogging detection device.

Further, a droplet ejecting device according to the present invention is used for patterning one of a wiring, a color filter, a photo-resist agent, a micro lens array, an electroluminescence material, and a bio-substance.

Further, the present invention provides a producing method for producing an electronic optical device, by using the aforementioned droplet ejecting device.

Further, the present invention provides an electronic optical device produced by using the aforementioned droplet ejecting device.

Further, the present invention provides an electronic device having the aforementioned electronic optical device mounted thereto.

DETAILED DESCRIPTION OF PREFERRED EMBODIMENTS

Hereinafter, description will be given of embodiments of the present invention, with reference to the drawings.

Figure 1:
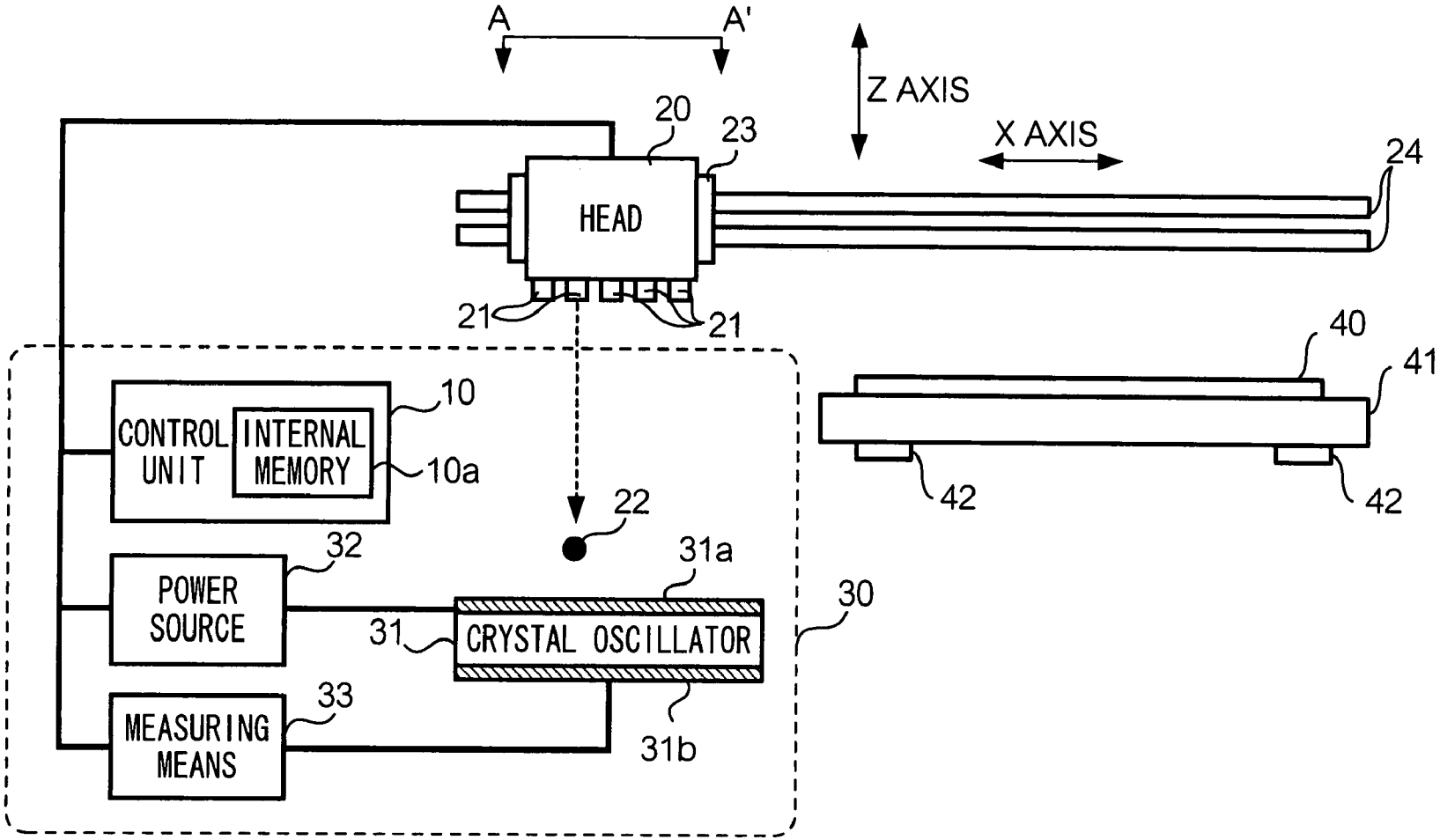
FIG. 1 is a configuration diagram of a droplet ejecting device according to an embodiment of the present invention.

FIG. 1 is a diagram showing a configuration of a droplet ejecting device having a nozzle clogging detection device according to one embodiment of the present invention. In the figure, a control unit 10 controls operation of the droplet ejecting device. Control unit 10 comprises an internal memory 10*a* capable of storing measured values obtained by a measuring means (described later in detail).

A head 20 comprises a nozzle group 21 controlled by control unit 10, ejects a droplet 2 from each of the nozzles in nozzle group 21. Droplet 22, for example, is a microscopic droplet of nanogram unit weight. A carriage 23 carries head 20. A first guide rail 24 extends along X-axis direction shown in the figure, and holds carriage 23 such that it is movable along the direction of the X-axis. Similarly, head 20 is movable along the direction of the X-axis. The process of producing an EL panel consists of an ejecting object 40 that corresponds to a substrate on which a luminescent layer is formed, and the luminescent layer is a target for droplet 22 to be ejected onto. A table 41 is for mounting ejecting object 40 thereon. A second guide rail 42 extends along Y-axis (not shown in FIG. 1) orthogonal to directions of X-axis and Z-axis in the figure, and holds table 41 movable in the direction of Y-axis. Ejecting object 40 is also movable in the direction of Y-axis, accordingly.

A crystal oscillator 31 is a piezoelectric element having the property of, when alternating current is applied, resonating at a natural frequency due to an inverse piezoelectric effect. Crystal oscillator 31 is provided such that quartz is sandwiched in between electrodes 31*a* and 31*b* which are respectively having a flat plate shape. Electrode 31*a* is placed opposite nozzle group 21 in a manner such that a droplet ejected from a nozzle adheres to the electrode. Power source 32 applies an alternating current to crystal oscillator 31 via electrodes 31*a* and 31*b*. A measuring means 33 electrically measures a resonance frequency of crystal oscillator 31 and outputs it to control unit 10.

It is to be noted that crystal oscillator 31, electrodes 31*a* and 31*b*, power source 32, measuring means 33, and control unit 10 consist of QCM (Quarts Crystal Micro balancer) 30 for detecting nozzle clogging in nozzles, each of which nozzle belonging to nozzle group 21. QCM30 is capable of detecting, by measuring means 33, the adherence of droplet 22 to electrode 31*a* because of a change in a resonance frequency of crystal oscillator 31. QCM30 is capable of detecting a change in weight of approximately several nanograms as a change in frequency of 1 Hz, and operates as a nozzle clogging detection device in the present embodiment.

Figure 2:
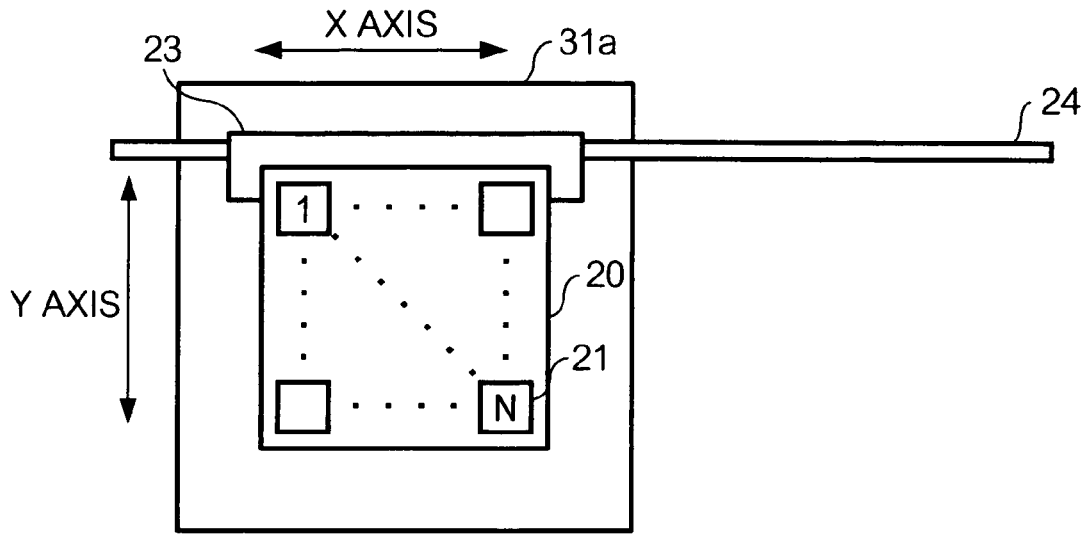
FIG. 2 is a diagram showing a positional relationship between a head and an electrode in the embodiment.

FIG. 2 is an abbreviated configuration diagram showing head 20 of FIG. 1 viewed by looking down along the Z-axis from above line AA'. Nozzle group 21 is shown in the figure for convenience. Nozzle group 21 consists of as many as N number of nozzles Nk (k=1,2, . . . N), wherein a plurality of nozzles are arranged on the undersurface of head 20, respectively in the directions of X-axis and Y axis. Electrode 31*a* has a broader area than an area of head 20 where nozzles Nk are arranged.

Figure 3:
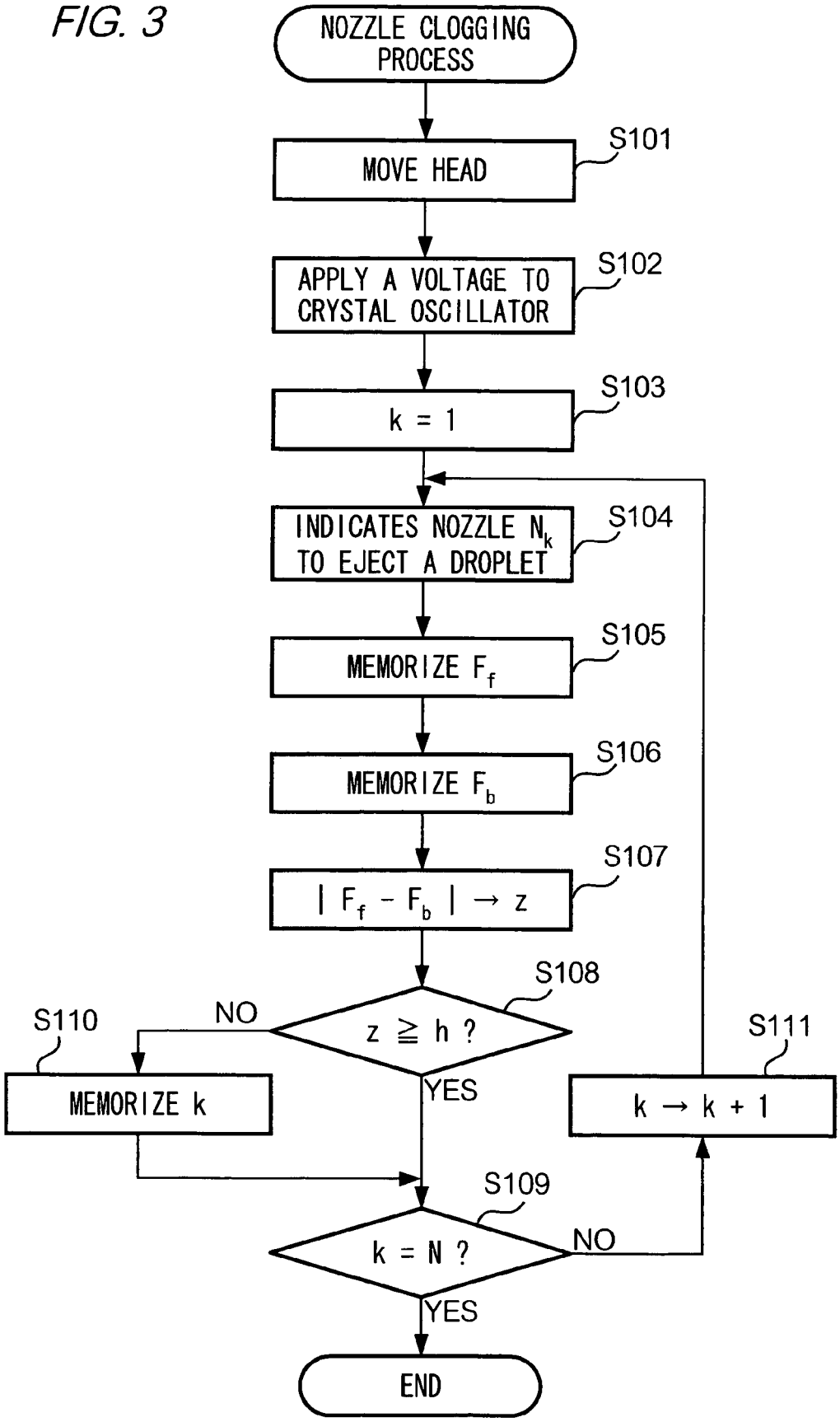
FIG. 3 is a flowchart showing a nozzle clogging detection process in the embodiment.

FIG. 3 is a flowchart for explaining a nozzle clogging detection process according to the present embodiment. With reference to the flowchart, a description will be given of the detection process.

When nozzle clogging detection process is started, control unit 10 carries head 20 so that head 20 and electrode 31*a* come into a positional relationship shown in FIG. 2 (step S101). Next, control unit 10 supplies a voltage to crystal oscillator 31 (step S102). By application of the voltage thereto, crystal oscillator 31 resonates at a certain frequency.

Next, control unit 10 sets variable k to "1" (step S103). It is to be noted that the variable k indicates each nozzle number: for example, k equal to 1 indicates nozzle N1. Next, control unit 10 transmits an indication for nozzle Nk to eject a droplet (step S104), and memorizes in internal memory 10*a* a value Ff of a frequency measured by measuring means 33 at this point of time (step S105). Subsequently, control unit 10 memorizes an internal memory 10*a* frequency Fb, which is measured by measuring means 33 at a point in time when a predetermined period of time has elapsed after an indication to eject a droplet is transmitted (step S106). When the values Ff and Fb are memorized by internal memory 10*a*, control unit 10 sets variable z to an absolute value of a difference between Ff and Fb (step S 107). Control unit 10 then determines whether variable z is greater than or equal to a predetermined value of h (step S 108).

Figure 4:
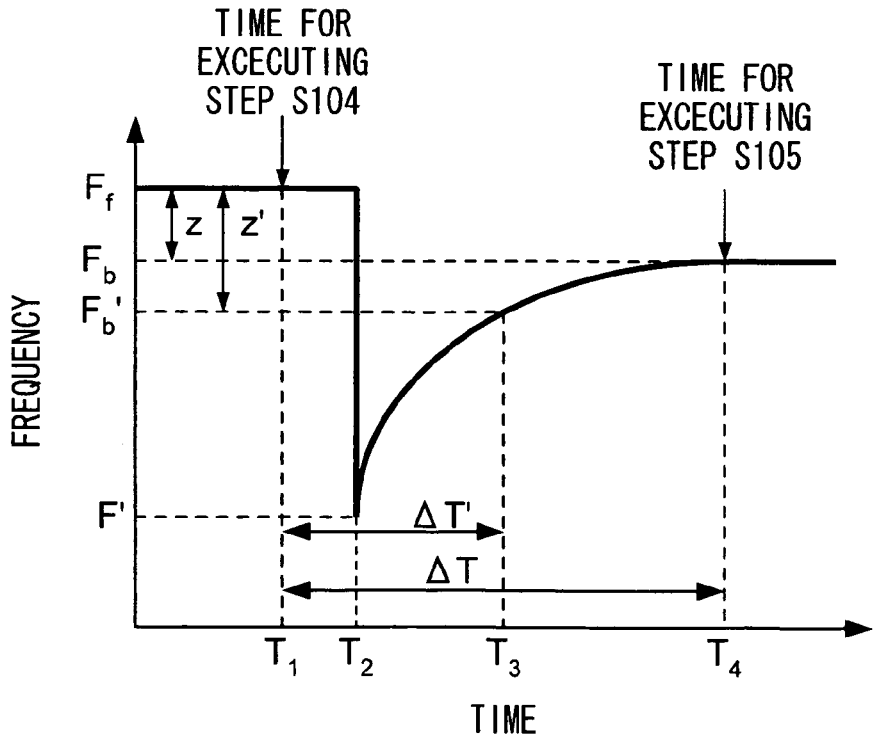
FIG. 4 is a diagram showing a difference in resonance frequency of a crystal oscillator in the embodiment.

FIG. 4 is a diagram showing an example of resonance frequency change of crystal oscillator 31. In the figure, step S104 is executed at time T1. At time T2, when droplet 22 adheres to electrode 31*a*, the resonance frequency instantly changes from Ff to F'. However, the frequency does not stabilize at F', but changes to become Fb and temporally stabilizes in general at Fb at time T4 when time ΔT elapses from time T1. In FIG. 4, ΔT corresponds to aforementioned "a predetermined period of elapsed time" and time T4 corresponds to a time for executing step S105.

It is to be noted that a value h should be set to a value well smaller than a magnitude z of the resonance frequency change of crystal oscillator 31 with regard to one droplet.

If a determination result in step S 108 is affirmative, which indicates that a droplet has been ejected normally from nozzle Nk, control unit 10 advances the process to step S109. If a determination result is negative, control unit 10 determines that a droplet has not been ejected normally from nozzle Nk and memorizes a value of variable k, i.e., a number of nozzle from which a droplet has not been normally ejected, in internal memory 10*a* (step S110).

In step S109, it is determined whether the process of nozzle clogging detection is performed for all the nozzles. In a case where there is a nozzle for which the process of nozzle clogging detection is not performed, i.e., in the case where a value of variable k is not equal to N of the number of the nozzle, a determination result in step S109 becomes negative. In this case, control unit 10 increases variable k by "1" and updates the nozzle number (step S111). Control unit 10 then returns the process to step S104 and repeats the process from step S104 to step S109 for all the remaining nozzles. When the process of nozzle clogging detection for N number of nozzles is completed, the determination result in step S109 becomes affirmative and the process of nozzle clogging detection is completed.

In a droplet ejecting device according to the present embodiment, QCM30, as described above, has electrode 31*a* having a broader area than the area where the nozzles are arranged, and has a configuration where every droplet that is ejected from nozzle group 21 is to be adhered to electrode 31*a*, when head 20 moves to detection position as shown in FIG. 2 at the time of starting the nozzle clogging detection process. Accordingly, head 20 is not required to move during the detection process; and in comparison with a conventional technique using a laser beam, wherein either a head or a detection unit should be moved, it is possible to greatly reduce the load on control unit 10 contingent to the detection process.

QCM30 which functions as a nozzle clogging detection device in the present embodiment is capable of recognizing, that a droplet has adhered to electrode 31*a* because a change in resonance frequency of crystal oscillator 31 can be detected. Therefore, in comparison with a conventional technique using a laser beam, in addition to fewer constraints of installation, QCM30 realizes nozzle clogging detection by ejecting merely one droplet.

In the present embodiment, electrode 31*a* has a broader area than the area of nozzle arrangement; however, electrode 31*a* may be smaller than an area of nozzle arrangement. In this case, although the process of nozzle clogging detection requires that head 20 or electrode 31*a* be moved, which results in increasing the load on control unit 10, nozzle clogging detection by ejecting merely one droplet is still possible, and the advantage of fewer constraints of arrangement is not impaired.

In addition, a droplet ejecting device according to the present invention enables nozzle clogging detection by ejecting one droplet, by utilizing the physical property of crystal oscillator 31, and does not require ejection of a plurality of droplets as is required in conventional techniques, whereby reducing costs and utilizing resources more effectively.

In the present embodiment, the process of nozzle clogging detection, for example, may be automatically performed at certain intervals. Alternatively, a user may instruct control unit 10 to perform the process at arbitrary times desired by the user.

In the present embodiment, control unit 10 memorizes temporally stable frequency Fb at time T4 (shown in FIG. 4) as a resonance frequency of a crystal oscillator after ejection of a droplet. However, frequency Fb' which is not temporally stable at time T3, when time ΔT' (<T) elapses from time T1 may be alternatively used.

In addition, control unit 10 may instruct ejection of a droplet within a time domain during which a resonance frequency of a crystal oscillator is temporally unstable, such as at time T3, thereby reducing the time required for carrying out the process of nozzle clogging detection.

It is to be noted that a droplet ejecting device according to the present embodiment, by selecting droplet 22 and ejection object 40, may be used for various applications other than ejecting an aforementioned EL material. Such applications may include, for example: wiring, color filter, photo-resist agent, micro lens array, and bio-substance chip.

Figure 5:
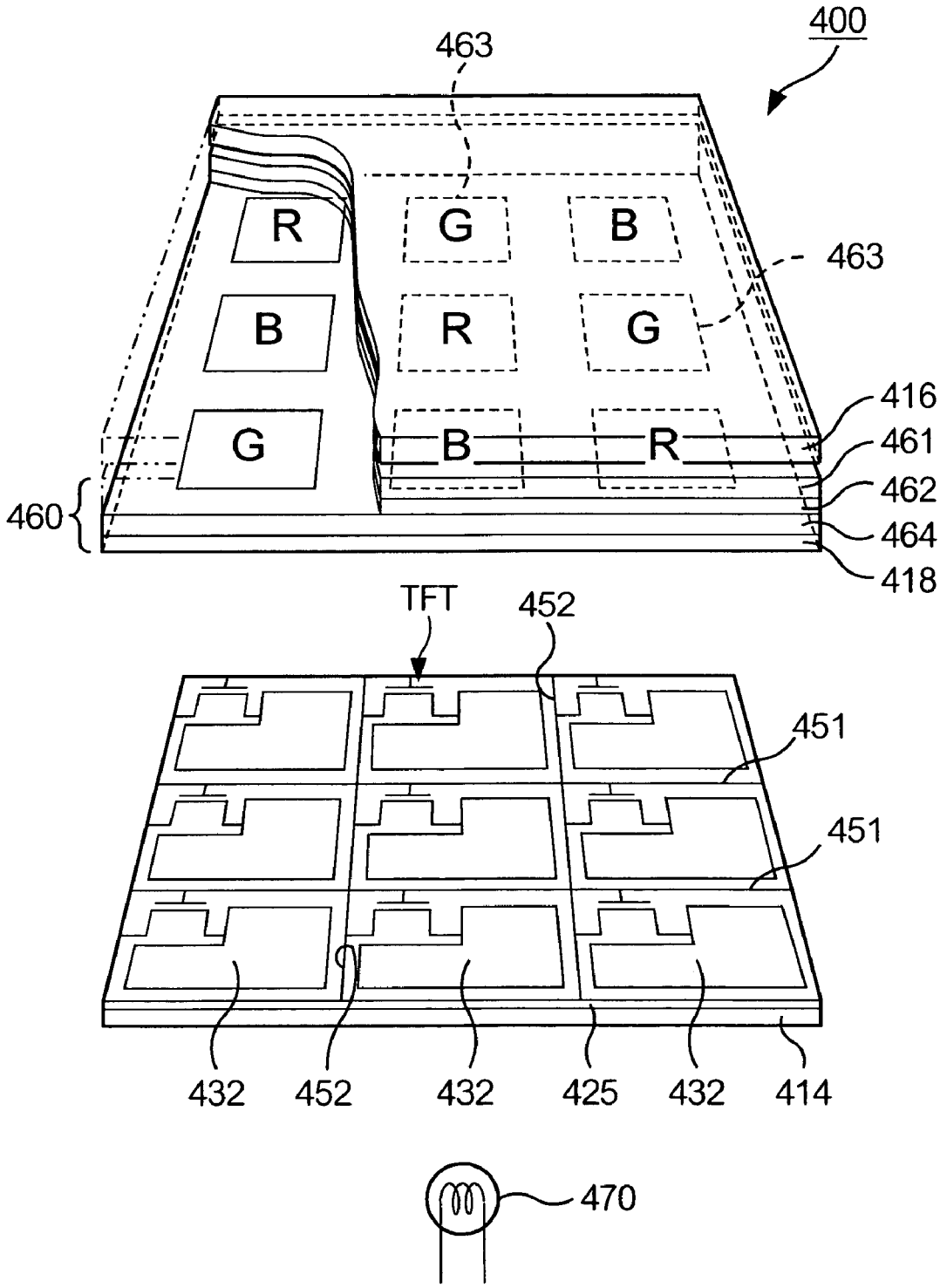
FIG. 5 is a diagram showing an example of a liquid crystal display device according to a second embodiment of the present invention.

FIG. 5 is a perspective view showing a configuration of a liquid crystal display device having a color filter mounted thereto, the color filter produced by using a droplet ejecting device according to the present invention, as a second embodiment of the present invention.

A liquid crystal display device 400 according to the present embodiment comprises accompanying elements such as a liquid crystal driving IC (not shown), a wiring element (not shown), a light source 470, a support member (not shown) and so on.

Now a brief description will be given of a configuration of liquid crystal display device 400. Liquid crystal display device 400 is configured as predominantly consisting of a color filter 460 and a glass substrate 414, provided to face each other, a liquid crystal layer (not shown) held between color filter 460 and glass substrate 414, a polarizing plate 416 mounted to the outside surface (observer's side) of color filter 460, and another polarizing plate (not shown) mounted to the inside surface of color filter 414. Color filter 460 comprising a substrate 461 consists of a transparent glass provided to observer's side, whereas glass substrate 414 is a transparent substrate provided to the opposite side. At the under side of substrate 461, a partition 462 consisting of black photosensitive resin film, a coloring unit 463 and an overcoat layer 464 are formed in this order, and under overcoat layer 464 is further formed an electrode 418 for driving. It is to be noted that in the actual liquid crystal device, an orientation film is provided at liquid crystal layer side, covering electrode 418, and also at glass substrate 414 side on electrode 432 (described below), however, it is not shown in the figure and its explanation is omitted.

Electrode 418 for liquid crystal driving, formed at liquid crystal layer side of color filter 460, consists of transparent conductive material such as an ITO (Indium Tim Oxide) which is formed on the entire surface of overcoat layer 464. On glass substrate 414 is formed an insulating layer 425 on which is formed a TFT (Thin Film Transistor) as a switching element, and a pixel electrode 432.

On insulating layer 425 formed on glass substrate 414 is formed a matrix of scanning lines 451 and signal lines 452, and a pixel electrode 432 is provided in each area defined by scanning lines 451 and signal lines 452. In a corner of each area surrounded by the lines 451 and 452, and a corner of each pixel electrode 432, is incorporated a TFT which comes into a state of ON or OFF by the application of a signal to scanning line 451 and signal line 452, thereby controlling passage of electric current through pixel electrode 432

Third Embodiment

Figure 6:
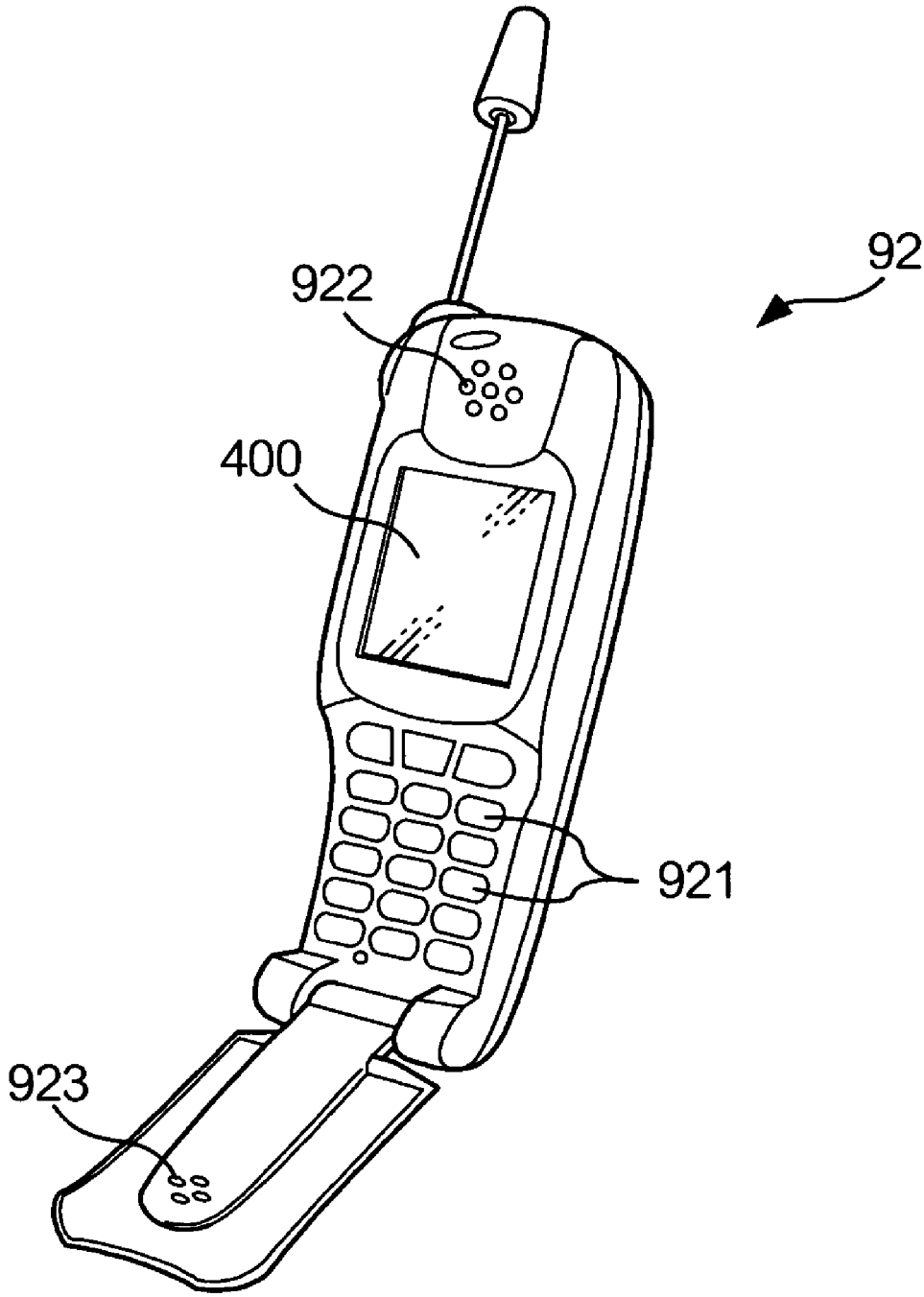
FIG. 6 is a diagram showing an example of a mobile telephone terminal according to a third embodiment of the present invention.

FIG. 6 is a perspective view of an example of configuration of a mobile phone which is, as a third embodiment of the present invention, an example of an electronic device using a liquid crystal display device according to the aforementioned second embodiment. In the figure, a mobile phone 92 comprises an aforementioned liquid crystal display device 400 in addition to a plurality of operation buttons 921, a receiver 92, and a mouthpiece 923.

What is claimed is:

1. A nozzle clogging detection device for detecting clogging of a nozzle which ejects a droplet, comprising:

a piezoelectric element which is held between two electrodes, and resonates at a certain frequency by being applied a voltage thereto, measuring means for measuring a resonance frequency of said piezoelectric element; and determining means for determining that clogging has occurred in a nozzle, by obtaining a resonance frequency of said piezoelectric element measured by said measuring means before and after the point of time at which a droplet is to be ejected via said nozzle to said piezoelectric element, when the difference between said obtained resonance frequencies is below a predetermined value.

2. A nozzle clogging detection device according to claim 1, further comprising a moving mechanism for moving said nozzle to a position so as to enable said nozzle to eject a droplet to said piezoelectric element.

3. A nozzle clogging detection device according to claim 1, wherein said determining means obtains a resonance frequency before and after a point of time at which a droplet is to be ejected from said nozzle, by causing said measuring means to measure a resonance frequency at a time when an indication for ejecting one droplet from said nozzle is generated, and to measure a resonance frequency of a predetermined time period after the time of generating the indication.

4. A nozzle clogging detection device according to claim 1, wherein said nozzle clogging detection device is for detecting nozzle clogging in a plurality of nozzles, said determining means causes a plurality of nozzles to eject a droplet sequentially; obtains a resonance frequency measured by said measuring means before and after the time at which a droplet is to be ejected via each of said plurality of nozzles; and determines, when the difference between the resonance frequencies obtained for a nozzle is below a predetermined value, that clogging has occurred in said nozzle.

5. A nozzle clogging detection device according to claim 4, wherein said determining means sequentially performs determination of nozzle clogging of said plurality of nozzles, under a condition where a voltage is being applied to said two electrodes.

6. A nozzle clogging detection device according to claim 1, wherein said piezoelectric element is a crystal oscillator.

7. A droplet ejecting device comprising the nozzle clogging detection device according to claim 1.

8. A droplet ejecting device according to claim 7, wherein the droplet ejecting device is used for patterning one of a wiring, a color filter, a photo-resist agent, a micro lens array, an electroluminescence material, and a bio-substance material.

9. A producing method for producing an electronic optical device, using the droplet ejecting device according to claim 7.

10. An electronic optical device produced by using the producing method according to claim 9.

11. An electronic device having the electronic optical device according to claim 10, mounted thereto.

* * * * *